US005954420A

United States Patent [19]

Smith

[11] Patent Number: 5,954,420

[45] Date of Patent: Sep. 21, 1999

[54] TELESCOPIC FLASHLIGHT

[76] Inventor: Victor Lee Smith, 412 E. Regent St. #1, Inglewood, Calif. 90301

[21] Appl. No.: 09/003,004

[22] Filed: Jan. 5, 1998

[51] Int. Cl.[6] ..... F21L 7/00

[52] U.S. Cl. ..... 362/198; 362/202; 362/208; 362/184

[58] Field of Search ..... 362/184, 198, 362/202, 208

[56] References Cited

U.S. PATENT DOCUMENTS

| | | | |
|---|---|---|---|
| D. 368,785 | 4/1996 | Nakao | D26/49 |
| 4,530,039 | 7/1985 | Shin-Shi | 362/202 |
| 5,077,644 | 12/1991 | Schaller . | |
| 5,097,399 | 3/1992 | Gammache . | |
| 5,197,796 | 3/1993 | Moore | 362/202 |
| 5,459,649 | 10/1995 | Ellion . | |
| 5,548,495 | 8/1996 | Maglica . | |
| 5,558,430 | 9/1996 | Booty . | |
| 5,586,819 | 12/1996 | Bamber . | |

FOREIGN PATENT DOCUMENTS 2118290 of 1983 United Kingdom .

*Primary Examiner*—Sandra O'Shea
*Assistant Examiner*—Todd Reed Hopper

[57] ABSTRACT

A telescopic flashlight having at least two cylindrical barrels of different diameters interconnected to slide one within another, engaged when partially extended by set screws, and when fully extended by matching threads located on each cylindrical barrel. The telescopic flashlight includes means to provide an adjustable housing capable of being axially extended or compressed to retain at designated intervals, a variable number of batteries connected in series alignment accommodated by the actuation of one or more lamp bulbs positioned inside one head assembly. The telescopic flashlight is also provided with individual adapters for batteries of smaller size to be utilized in place of standard "D" size batteries.

12 Claims, 3 Drawing Sheets

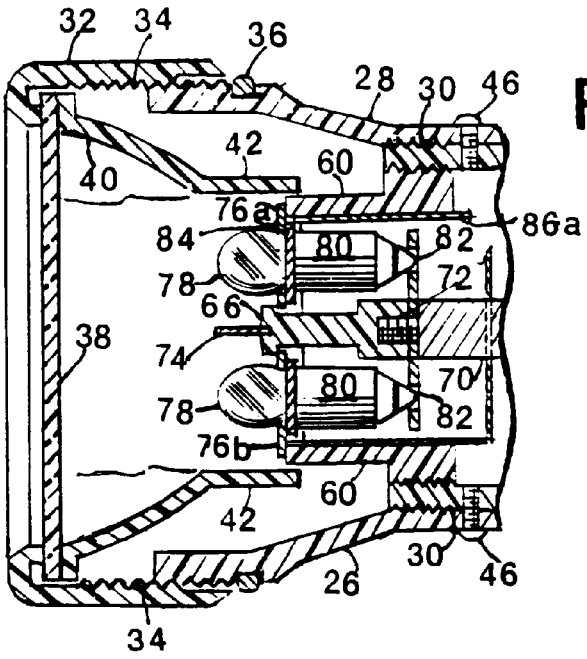
FIG. 4
FIG. 5
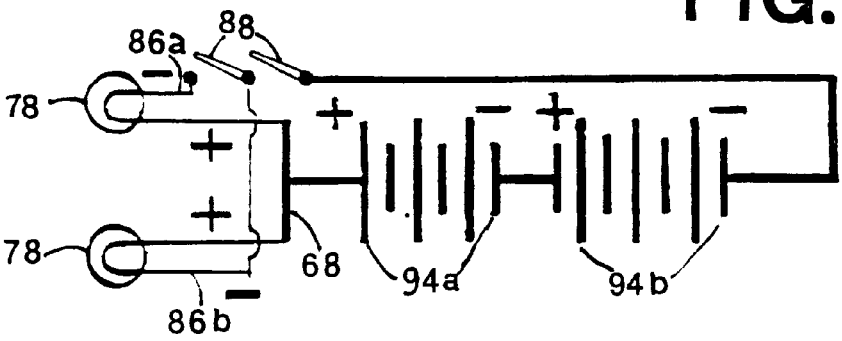
FIG. 6
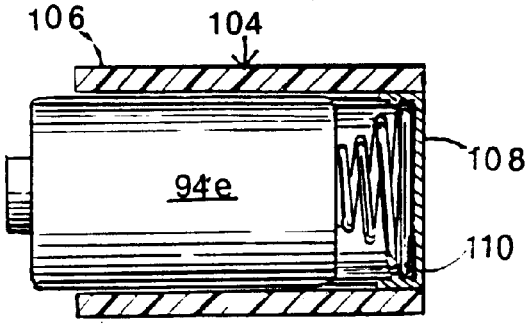

TELESCOPIC FLASHLIGHT

BACKGROUND

1. Field of Invention

This invention relates to flashlights, and in particular to a handheld flashlight that can be telescopically adjusted to hold a variable number of batteries, accommodated by the actuation of one or more lamp bulbs in a single head assembly for improved versatility and reliability.

2. Description of Prior Art

Heretofore, a wide variety of flashlights of various shapes and sizes have been proposed and implemented for use as portable light sources. In particular, it is known that certain of these handheld flashlights utilize two or more dry cell batteries, carried in series alignment inside a cylindrical tube or barrel. Generally, the number of batteries in a given flashlight, regardless of shape or size is fixed, indicating that if one battery fails, the flashlight is rendered useless, unless a replacement battery or another flashlight is readily available. In many emergency situations, other batteries or flashlights are not availble, thus causing serious problems or inconvenience.

Although the technology for manufacturing dry cell batteries have advanced significantly over the years, the basic concept is essentially the same. It is common knowledge for example that, it is still difficult in practice to predict how many ampere hours a dry cell battery will deliver, or precisely how long it will last. Basically, the amount of electricity actually stored in a battery depends primarily on the size of the battery, and the skill and knowledge of the manufacturer. Typically, the amount of electricity which can be obtained from a dry cell battery depends very largely on the rate at which the battery is discharged, that is the amount of current which the battery is called upon to deliver. More often than not, the discharge rate will vary from battery to battery, even when batteries are in use under similar conditions, which means that all batteries in a flashlight will not necessarily discharge at the same rate or time. This can be a serious disadvantage under certain circumstances especially when a flashlight is needed, and just one battery is dead. In some instances, it is exacerbated by flashlight users when batteries of different qualities are used in the same flashlight or when older batteries are mixed with newer ones, but of course in cases of emergency it is advisable to use any flashlight battery that will temporarily solve the problem. From the foregoing information, it can be seen that with flashlights in particular, series circuits are very vunerable to failure if one component in the circuit fails, such as a battery, lamp bulb, or switch, which obviously lessens the efficiency.

Moreover, the possible failure of the flashlight lamp bulb is another very important consideration, which is crucial to flashlight operation. In comparison to battery technology, lamp bulbs have been vastly improved over the years, even to a greater degree. Specifically, the intensity, versatility, and longevity of flashlight lamp bulbs have improved via the development of better filiaments, different eases and envelopes used, along with improved manufacturing procedures. Flashlight bulbs can now be produced to last longer, burn brighter, and operate over a wider range of voltage and current, but even with these advancements, it is still a big disadvantage to rely on a single lamp bulb in a series circuit. This is because the life of flashlight bulbs, in spite of improvements are still unpredictable, just as batteries, and will often burn out at an inconvenient time. Flashlight bulbs can burn out as a result of age, improper use or just a defect in manufacturing.

Another consideration involves the variable dispersion of the flashlight beam, which has been limited by some flashlights that use specialized light bulb designs. Although these lamp bulb designs allow for sharper focus of the light beam, most standard or universal type bulbs as a rule cannot be used with these particular flashlights, which can sometime represent a major problem when such a specialized bulb burn out, and there is no available replacement.

Most users, therefore would find it most desirable to have a more economic and reliable flashlight that use standarized components, wherein the possibility of failure is minimized, along with eliminating the need to have multiple flashlights of different lengths and sizes.

OBJECTS AND ADVANTAGES

Accordingly we claim the following as objects and advantages of the invention: to provide a handheld flashlight comprising at least two interconnected cylindrical barrels or tubular sections of different diameters, that slide one within the other, to provide a flashlight that can be telescopically adjusted to hold a variable number of batteries in series alignment, accommodated when in operation by the actuation of one or more lamp bulbs located inside a single head assembly, to provide a flashlight that does not rely on a fixed number of batteries or one lamp bulb for its performance, thereby minimizing the possibility or complete failure.

It is another object of the present invention to provide a telescopic flashlight wherein the user can increase or decrease the intensity of the light beam by merely adding or deleting batteries to the adjustable housing, in conjunction with the actuation of one or more lamp bulbs in the head assembly, to provide in addition, a safeguard against failure of the flashlight in the event that one lamp bulb or one battery happens to fail.

Another object of the invention is to provide a telescopic flashlight with one or more lamp bulbs located in the head assembly that can be actuated separately or concurrently, via the incorporation of a series-parallel electrical switch function in a circuit with a lamp bulb holder that serve as a mounting that provide separate electrical conductors for each lamp bulb connecting the switch.

It is another object of the present invention to provide a telescopic flashlight that will produce a beam of light with a variable focus, wherein a parabolic reflector with an extended cylindrical portion can be adjusted to control the focus of one or more lamp bulbs inside a single head assembly.

It is another object of the invention to provide a flashlight with a head assembly that can be completely disengaged or removed from one of the cylindrical barrels or tubes without interrupting or breaking the circuit producing the light beam, thus providing a versatile light source capable of being held vertically like an electric torch or placed vertically on a flat horizonal surface similar to a table lamp.

It is another object of the invention to provide a flashlight with an adjustable housing that can be collasped or compressed for easy storage when not in use.

It is a further object of the invention to provide adaptors capable of accommodating individual batteries, that can be utilized to allow the insertion of batteries of smaller diameter and shorter length into the adjustable flashlight housing.

Readers will find further objects and advantages of the invention from a consideration of the ensuing description and the accompanying drawings.

DRAWING FIGURES

FIG. 4 shows the head assembly of the telescopic flashlight illustrating how the face cap together with the lens and reflector can be axially rotated as a unit to change the focus.

FIG. 5 shows an electrical diagram illustrating how a series parallel switch is utilized to actuate one or more lamp bulbs in a partially divided series circuit.

FIG. 6 shows a simple adaptor that can allow different size batteries to be utilized with the telescopic flashlight as will as other handheld flashlights.

DRAWING REFERENCE NUMERALS

Figure 1:
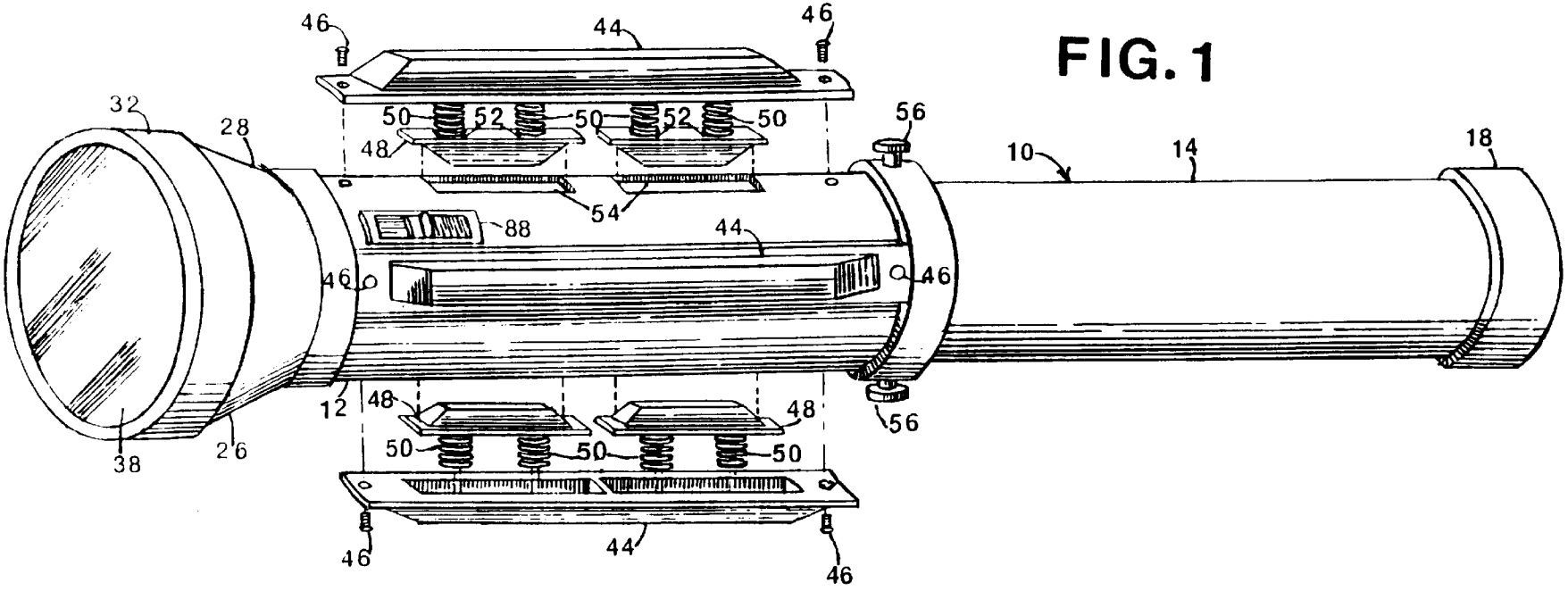
FIG. 1 shows a perspective view of a telescopic flashlight fully extended with a partially exploded view illustrating components utilized to hold the batteries in series alignment.

10 telescopic flashlight
12 outside cylindrical barrel
14 inside cylindrical barrel
16 threads of 14
18 tail cap of 14
20 threads of 18
22 metal disc or ring
24 spring element
26 head assembly of 12
28 head of 26
30 threads of 28
32 face cap of 28
34 threads of 32
36 sealing element or O-Ring
38 lens
40 parabolic reflector
42 cylindrical portion of 40
44 elongated recess covers
46 rivets or screws of 44
48 retractable alignment bars
50 coil springs
52 seats of 50
54 slots in 12
56 set screws in 12
58 sealing element or O-ring
60 lamp bulb holder
62 flat front portion of 60
64 threads of 60
66 dielectric shaft
68 washer-like conductor
70 conducting pin
72 threads of 70
74 focusing divider
76*a*,76*b* reflective conducting plates
78 lamp bulbs
80 lamp bulb bases
82 tips of 80
84 flanged portion of 80
86*a*,86*b* negative conducting leads
88 series parallel switch
90*a*,90*b* conductive elements of 12 and 14
92 sliding contact
94*a*,94*b*,94*c*,94*d* batteries in series
96 negative case electrode
98 positive center electrode
100 arrow-forward direction
102 arrow-rearward direction
104 adaptor
106 dielectric tube
108 cap-shaped electrical contact
110 spring member

TELESCOPIC FLASHLIGHT—DESCRIPTION

Figure 2:
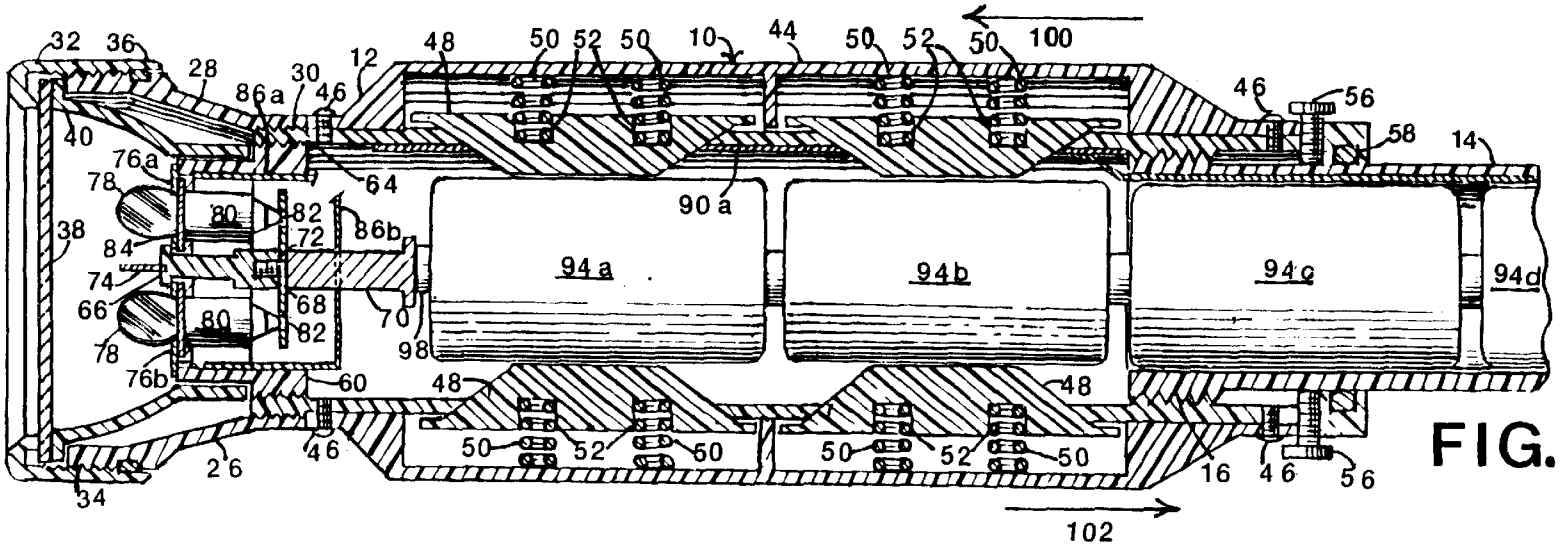
FIG. 2 shows a partial cross-sectional side view of the telescopic flashlight in an extended or stretched out position.
Figure 3:
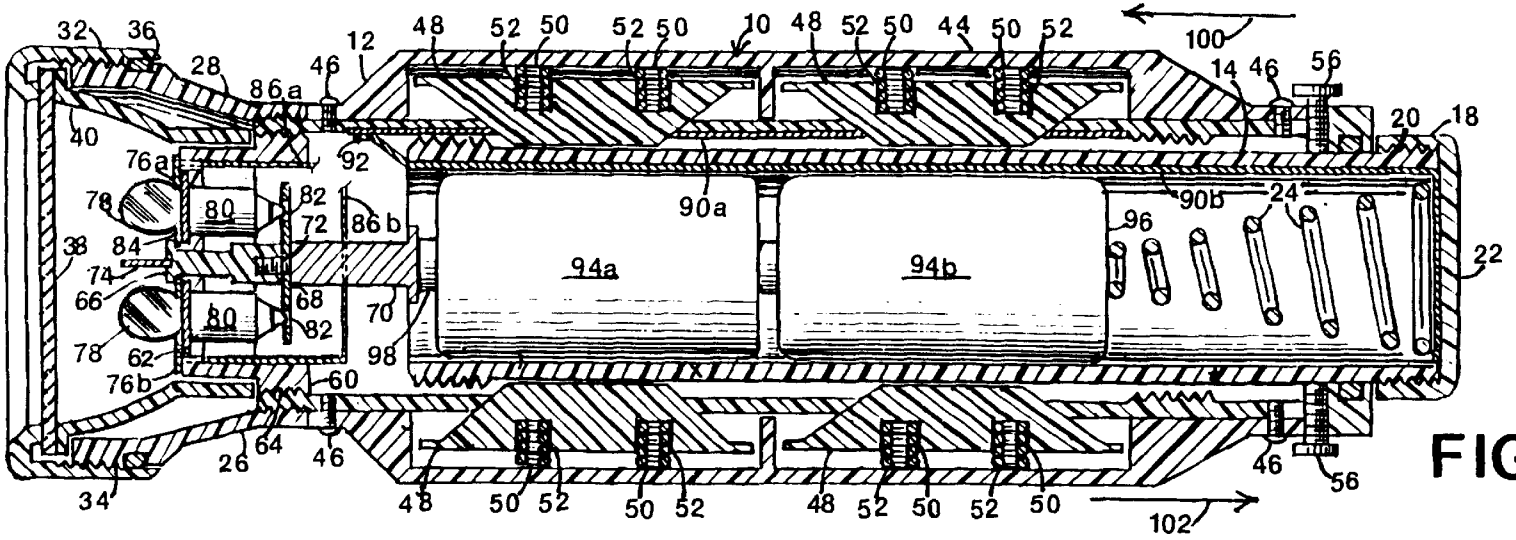
FIG. 3 shows a cross-sectional side view of the telescopic flashlight in a collasped or compressed position.

The overall basic construction of the telescopic flashlight of FIGS. 1,2,3, and 4 is essentially the same. In the embodiment of FIGS. 1,2, and 3, at least two interconnected cylindrical barrels or tubular sections of different diameters are shown. The construction of the telescopic flashlight is now described.

A telescopic flashlight 10 is comprised of at least two right circular or cylindrical barrels 12 and 14 of different diameters interconnected to slide one within another, enclosed at a first end of an inside cylindrical barrel 14 by a tail cap 18 with threads 20, and having a head assembly 26 enclosing a second end of an outside cylindrical barrel 12 thereof. The cylindrical barrels 12 and 14 are engaged when partially extended by set screws, and when fully extended by matching threads 16. Both cylindrical barrels can be made of dielectric as well as metallic materials.

The head assembly 26 of the telescopic flashlight 10 has a diameter slightly greater than that of the outside cylindrical barrel 12 and is adapted internally with threads 30 that match and engage external threads located on the exterior surface of the forwardmost end of the outside cylindrical barrel 12. The head assembly 26 comprises the head 28 to which is affixed a face cap 32 which retains a lens 38 and a parabolic reflector 40 with an extended cylindrical portion 42. A lamp bulb holder 60 which retains at least two lamp bulbs 78 is also located within the head assembly 26, but operate independently of the face cap 32,lens 38, and parabolic reflector 40. The face cap 32 in connection with the lens 38, and parabolic reflector 40 operate as a unit that can be adjusted and/or disengaged from the head 28 without breaking the electrical circuit of the flashlight. The face cap 32 is adapted internally with threads 34 that match and engage threads on the forwardmost end of the head 28, which allows adjustment as well as engagement or disengagement from the head 28. A sealing element 36 in the form of an O-ring is provided at the interface between the face cap 32 and the head 28 to provide a water-tight seal when the face cap 32 is partially or completely screwed to the head 28 by means of the threads 34.

In reference to the tail cap 18, a metal disc 22 or ring of metal, and a spring element 24 is positioned within the tail cap 18 so as to make electrical contact with a negative case electrode 96 of an adjacent battery 94*b* of FIG. 3. The Spring element 24 as with most handheld flashlights is used to maintain electrical contact between the batteries 94*a*,94*b*, 94*c*,94*d*, and conductive elements 90*a*, and 90*b* of the outside and inside cylindrical barrels 12 and 14. When the cylindrical barrels 12 and 14 are adjusted or moved, electrical continuity between the conductive elements 90*a* and 90*b* is maintained by a sliding contact 92 which is an extention of the conductive element 90*b* of the inside cylindrical barrel 14.

The positive center electrode 98 of the forwardmost battery 94*a* is urged into contact with a conducting pin 70, and held against the pin by tension provided by the spring element 24 positioned within the tail cap 18 that create pressure against the negative case electrode 96 of the rearmost battery 94*b* of FIG. 3. Preferably the conducting pin 70 is made of a non-ferrous metal conductor with threads 72 at the front end similar to an ordinary bolt, that screws into a dielectric shaft 66 which is mounted through a central opening or hole cut into the dielectric lamp bulb holder 60. A washer-like conductor 68 made of a circular flat non-ferrous metal with a hole in its center is held or positioned between the conducting pin 70 and the dielectric shaft 66, the purpose of which is to provide a common conducting path from the conducting pin 70 to one or more lamp bulbs 78 located within the head assembly 26. The washer-like conductor 68 can be notched or indented at equal points near the outer edge or periphery, to hold the tips 82 of the lamp bulb bases 80 in place, in order to maintain good electrical contact on the positive side of the circuit. The lamp bulb holder 60 is a dielectric cup-shaped receptable designed with at least two circular offset openings cut into the flat front portion 62 of the lamp bulb holder 60 for the purpose of retaining at least two lamp bulbs 78. The rear portion of the lamp bulb holder 60 is designed with exterior threads 64 that match and engage interior threads located on the forward-most end of the outside cylindrical barrel 12. With the detachment of the lamp bulb holder 60 from the outside cylindrical barrel 12, access is provided for the engagement or disengagement of the conducting pin 70, and washer-like conductor 68 that hold the lamp bulbs 78 in position against semi-circular reflective conducting plates 76*a* and 76*b* mounted on the flat front portion 62 of the lamp bulb holder 60. Standard lamp bulbs 78 can be inserted or removed from the rear of the lamp bulb holders.

The metal flanged portion 84 of the lamp bulb bases 80 rest or is seated against the reflective conducting plates 76*a* and 76*b* that are mounted separately with a high temperature adhesive or small rivets (not shown) or by other common means to the flat front portion 62 of the lamp bulb holder 60. The reflective conducting plates 76*a* and 76*b* serve in a dual capacity as separate electrical conductors for each lamp bulb 78, and partial reflective surfaces for the back reflection of light emanating from the lamp bulbs 78. Each reflective conducting plate 76*a* and 76*b* is connected separately to negative conducting leads or wires 86*a* and 86*b* that terminate at separate contact points located on a series parallel switch 88 which is designed to actuate each lamp bulb 78 individually or concurrently. The series-parallel switch 88 is mounted externally on the outside cylindrical barrel 12 as shown in FIG. 1 as well as symbolically in FIG. 5.

Aforementioned, the head 28 is engaged externally to the outside cylindrical barrel 12 by threads 30 formed on the interior surface of the head 28 that engage matching threads on the exterior surface of the front portion of the outside cylindircal barrel 12. Although provisions are made for the head assembly 26 to be unscrewed or disengaged from the outside cylindrical barrel 22 to insert batteries, it is not normally required. The face cap 32 in conjunction with the lens 38, parabolic reflector 40, and cylindrical portion 42 thereof, is also provided with the capability of disengagement or adjustment when axially rotated about the head 28 in a forward direction 100. With this capacity, the replacement or removal of parts, such as batteries or lamp bulbs can easily be accomplished from both ends if necessary. Another important function of the face cap 32 as shown in FIG. 4 shows how axial rotation of the face cap 32 about the head 28 in a forward direction 100 cause a change in position of the face cap 32 in relationship to the head 28, and the lamp bulb holder 60. Specifically, the short cylindrical portion 42 of the parabolic reflector 40 connecting the lens 38, and face cap 32 is designed with an inside diameter slightly larger than the outside diameter of the front portion of the lamp bulb holder 60 so that when the face cap 32 is axially rotated about the head 28 in a forward direction 100 indicated by the arrow, the short cylindrical portion 42 of the parabolic reflector 40 will move or slide forward to act as a focusing shield or cover for the lamp bulbs 78, thus producing a narrower dispersion of the light beam as illustrated in FIG. 4. Further control of the light beam is provided by a focusing divider 74, which is a thin dielectric vane of material designed to fit into the notched front end of the dielectric shaft 66. The focusing divider 74 serves to assist in focusing one or all of the lamp bulbs 78 when actuated separately or together.

With reference to the inside and outside cylindrical barrels 12 and 14 of the telescopic flashlight 10, the inside cylindrical barrel 14 is designed with a diameter and length capable of accommodating at least one standard flashlight battery disposed in series alignment as shown in FIG. 3. It is also true that the outside cylindrical barrel 12 has sufficient length to hold at least one standard flashlight battery 94*a*, but when the flashlight is partially or fully extended, its larger diameter under normal circumstances cannot hold the batteries 94*a* or 94*b* in series alignment, therefore a plurality of spring loaded retractable alignment bars 48 are implemented to hold the batteries in place, or make the adjustment when the telescopic flashlight 10 is fully extended as shown in FIG. 2. The telescopic flashlight 10 is also designed to be partially extended to accommodate at least one additional battery as stated, or fully extended to accommodate at least two additional batteries 94*c* and 94*d* as shown in FIG. 2 The spring loaded retractable alignment bars 48 are equally spaced and positioned around the circumference and along the length of the outside cylindrical barrel 12 in a manner to accommodate each battery individually as shown in FIG. 1 and FIG. 2. Each battery 94*a* and 94*b* in the outside cylindrical barrel 12 is held in place or series alignment by the retractable alignment bars 48 as shown in FIG. 2. The spring loaded retractable alignment bars 48 in this arrangement are made of dielectric materials with circular inset openings on each bar that serve as seats 52 for coil springs 50 that allow the bars to move back and forth laterally through a plurality of slots 54 that are cut into the wall of the outside cylindrical barrel 12. The slots 54 cut into the wall of the outside cylindrical barrel 12 provide elongated openings for the retractable alignment bars 48 to pass through with tension on the coil springs 50 produced by contact or pressure exerted against the inner surface of the elongated recess covers 44. The elongated recess covers 44 can be attached to the outer wall of the outside cylindrical barrel 12 by screws, rivets 46 or by other means as shown in FIGS. 1,2, and 3. The elongated recess covers 44 are provided as containment recesses or cavities for the coil springs 50 and the retractable alignment bars 48 as shown in FIGS. 1,2, and 3.

As mentioned, the inside cylindrical barrel 14 with its smaller diameter is designed to be pushed in or pulled out of the outside cylindrical barrel 12 similar to a telescope when batteries are inserted or removed. When the inside cylindrical barrel 14 is partially extended, simple set screws 56 located near the rear portion of the outside cylindrical barrel 12 can be used to hold the inside cylindrical barrel 14 in position. A sealing element 58 in the form of an O-ring is provided at the interface between the outside and inside cylindrical barrels 12 and 14 to maintain a watertight seal when the inside cylindrical barrel 14 is pushed within the outside cylindrical barrel 12 in a forward direction 100 or pulled out in a rearward direction 102 as indicated by the arrows. When the telescopic flashlight 10 is fully loaded with batteries, and the inside cylindrical barrel 14 is fully extended or pulled out, both inside and outside cylindrical barrels 12 and 14 are screwed together by a region of external threads 16 located on the front portion of the inside cylindrical barrel 14 that match internal threads located near the rear portion of the outside cylindrical barrel 12 as shown in FIG. 2 and FIG. 3. In the Embodiment of FIG. 3 the inside cylindrical barrel 14 is shown fully collasped or pushed within the outside cylindrical barrel 12, providing a telescopic flashlight 10 with the capability of holding at least one battery in each section of the cylindrical barrels 12 and 14.

Again, when the inside cylindrical barrel 14 is pushed within the outside cylindrical barrel 12, the retractable alignment bars 48 are forced by spring action to retract laterally into hollow spaces or cavities provided by the elongated recess covers 44 which are attached by screws, rivets 46 or other means to the outer wall of the outside cylindrical barrel 12 as shown in FIGS. 1,2, and 3. As a result, the retraction of the alignment bars cause compression of the coil springs 50 against the inside surface of the elongated recess covers 44 as shown in FIG. 3. Conversely, FIG. 2 shows that when the inside cylindrical barrel 14 is fully extended or stretched out with threads 16 engaging threads on the outside cylindrical barrel 12, the coil springs 50 seated within the retractable alignment bars 48 are shown in a relaxed position, thereby providing means to hold the batteries 94*a* and 94*b* in series alignment inside the outside cylindrical barrel 12. The retractable alignment bars 48 serve to maintain the series alignment of at least one battery 94*a* inside the outside cylindrical barrel 12 which match the series alignment of other batteries located within the inside cylindrical barrel 14, thus providing a telescopic flashlight 10 with the capacity to deliver a variable or higher voltage output capable of producing a more intense beam of light which can be enhanced by the actuation of more than one lamp bulb 78.

In addition to providing a telescopic flashlight 10 with the advantage of having one or more lamp bulbs 78 disposed in one head assembly 26 along with the capacity to operate on two or more batteries, FIG. 6 shows an adaptor 104 as another enhancement that will allow batteries of smaller diameter and length to be utilized within the outside and inside cylindrical barrels 12 and 14. As illustrated in FIGS. 2 and 3, the batteries disposed in series alignment are of the standard "D" size variety, which are commonly utilized in most handheld flashlights. In FIG. 6 a "C" size battery 94*e* is shown disposed within an adaptor 104 that approximate the size of a "D" size battery, the purpose of which is to allow "C" size batteries to be adapted for use in standard handheld flashlights containing "D" size batteries as shown in FIGS. 2 and 3.

The adaptor 104 itself comprises a short dielectic tube 106 or cylinder designed with a cap-shaped electrical contact 108 made of a non-ferrous conductor connecting a short spring member 110 which is designed to maintain electrical contact with the negative case electrode of the "C" size battery 94*e*. The cap-shaped electrical contact 108 containing the spring member 110 is pressed into one end of the dielectric tube 106 which can be made of inexpensive plastic that approximate the outside diameter of a "D" size battery, and an inside diameter that will allow easy insertion and removal of a "C" size battery 94*e*. The compensation for the length of the "C" battery 94*e* is provided by the spring member 110 and the cap-shaped electrical contact 108. It is also important to know that although the current ratings of "C" and "D" size batteries differ in value, the voltage pressure of each battery is approximately 1.5 volts, which suggest that "C" size batteries can be easily adapted to work in flashlights that normally hold "D" size batteries as long as proper series alignment or electrical contact is maintained. Lamp bulbs of standard variety can also be used to accommodate both sizes.

TELESCOPIC FLASHLIGHT—OPERATION

Referring to the embodiment of FIGS. 2,3, and more particularly to the electrical diagram o FIG. 5, the operation of the telescopic flashlight 10 is described.

The series-parallel switch 88 is provided as an intergral part of the electrical system, and is known in the art as a multifunction electrical device comprising two or more switches interconnected or combined for the purpose of changing series connections to parallel or vice versa. According to the electrical diagram of FIG. 5, two associated switches are shown side by side in open positions which symbolically represent the series-parallel switch 88 herein described, Another intrinsic part of the electrical diagram depicts two lamp bulbs 78 in connection with two negative conducting leads 86*a* and 86*b* that terminate on separate connections on the series-parallel switch 88. The multi-switch function provided by the series-parallel switch 88, in conjunction with the separated reflective conducting plates 76*a* and 76*b* along with the negative conducting leads 86*a* and 86*b* shown in FIGS. 2,3, and 4, allows for the operation of a partially divided series circuit that can also be operated in parallel when both switches are in closed positions as represented by the dotted lines in FIG. 5. More specifically, when both switches comprising the series-parallel switch 88 are in closed positions as indicated by the dotted lines in FIG. 5, current flows from the negative case electrode 96 of the rearmost battery as shown in FIG. 3 to the positive center electrode 98 of the forwardmost battery 94*a* which is in series connection. Once current pass through the positive center electrode 98 of the forwardmost battery 94*a*, it then pass through the conducting pin 70 connecting the washer-like conductor 68 which acts as a common positive conductor for the positive tips 82 of the lamp bulb bases 80 as shown in FIGS. 2,3, and 4. From the filiaments of the lamp bulbs 78, the electrical energy emerges through the negative electrodes or flanged metal bases 84 of the lamp bulbs 78, which are in contact with reflective conducting plates 76*a* and 76*b* located on the flat front portion 62 of the lamp bulb holder 60 shown in FIGS. 2,3, and 4. The reflective conducting plates 76*a* and 76*b* serve to separate or split the current flowing from the lamp-bulbs 78 to the connections on the series-parallel switch 88, via negative conducting leads 86*a* and 86*b* that provide two separate paths of conduction for the current to follow. The completion of the circuit from the series-parallel switch 88 to the rearmost battery 94*b* is provided by what can be defined as positive conductive elements 90*a* and 90*b* connected in series, and attached or embedded in the inner walls of the outside and inside cylindrical barrels 12 and 14. Since the cylindrical barrels are movable, a sliding contact 92 as an extention of the inside cylindrical barrel 14 is provided to maintain electrical continuity between the cylindrical barrels 12 and 14, as shown in FIGS. 2 and 3. On emerging from the series-parallel switch 88, the current then flow via the conducting elements 90*a* and 90*b* to the metal disc 22 or electrical contact located inside the tail cap 18, which is in contact with the spring element 24 and rearmost battery 94*b*, thus completing the circuit.

In this particular scenario, the electrical diagram of FIG. 5 shows two lamp bulbs 78 being actuated by a series-parallel switch 88 comprising two switches interconnected as shown by dotted lines in closed positions. As stated, the series-parallel switch 88 is in connection with negative conducting leads 86*a* and 86*b* that are connected to the lamp bulbs 78 via reflective conducting plates 76*a* and 76*b* that are attached to the face of the lamp bulb holder 60. With this arrangement, two partially separated circuits are established under the control of the series-parallel switch 88, and according to the electrical diagram of FIG. 5, the series-parallel twitch 88 has the capability of actuating one or more lamp bulb 78 in series or parallel when both switches are in closed positions. Each lamp bulb 78 utilized, has the capacity based on the current state of the art, to handle the fully loaded telescopic flashlight 10. The preferred voltage rating for each lamp bulb 78, based on the illustrations should be in a range of 1 to 6 volts or a minimum of 1 to 3 volts which can handle at least two batteries in series alignment. Since it is well known that most standard flashlight batteries have a voltage rating of approximately 1.5 volts each, it is obvious to those skilled in the art that with the proper current rating, it is feasible for one lamp bulb 78 to accommodate the fully loaded telescopic flashlight 10 if desited. Although it is not desired as a primary objective, one lamp bulb 78 is used primarily when one lamp bulb fails, or when one or more batteries fails which means that it is also provided as a back-up or as an alternative in avoiding the complete failure of the flashlight circuit. Ideally, the maximum efficiency or intensity of light is derived by the actuation of more than one lamp bulb when the telescopic flashlight 10 is fully loaded with batteries, but again it is also very important to know that the telescopic flashlight 10 can be adjusted to operate on a minimum of two batteries as shown in FIG. 3 and symbolically in FIG. 5, which again helps in minimizing the possibility of complete failure.

While the above description contains many specificities, the reader should not construe these as limitations on the scope of the invention, but merely as exemplifications of preferred embodiments thereof. Those skilled in the art will envision other possible variations within its scope. For example, skilled artisans will readily be able to change the dimensions, and shapes of the various embodiments. They will be able to make variations of the spring loaded retractable alignment bars by us ing spring in other forms and sizes. They can make the outside cylindrical barrel of FIGS. 1,2, and 3 containing the spring loaded retractable alignment bars, slotless by further increasing the diameter and eliminating the recess covers, while providing a plurality of hidden recess cavities located on the inner wall of the cylindrical barrel. They can completely eliminate the spring loaded retractable alignment bars, and the elongated recess covers shown in FIGS. 1,2, and 3 by inserting the batteries in short individual sleeves that can be used as accessories to compensate for the larger diameter of the outside cylindrical barrel. In this case, the sleeves would be supplied by the manufacturer as intergral components necessary for the full operation of the flashlight. They can also make the inside and outside cylindrical barrels of FIGS. 1,2, and 3 longer or with more sections for purpose of accommodating more batteries which could also necessitate the addition of more lamp bulbs. As a matter of fact, a number of known methods can be envisioned to adjust the length of the telescopic flashlight. Accordingly the reader is requested to determine the scope of the invention by the appended claims and their legal equivalents and not by the examples given.

What is claimed is:

1. A telescopic flashlight comprising:

at least two cylindrical barrels of different diameters interconnected to slide one within the other, enclosed at a first end of an inside cylindrical barrel by a tail cap threadable attached thereto, and having a head assembly with threads enclosing a second end of an outside cylindrical barrel;

means for having an adjustable flashlight housing adapted to be extended or compressed axially to retain at designated intervals, a variable number of flashlight batteries connected in series alignment accommodated by the actuation of one or more lamp bulbs positioned inside one lead assembly; and a plurality of spring loaded retractable alignment bars retained by a plurality of elongated recess covers spaced equally around said outside cylindrical barrel;

means to hold said batteries in series alignment when said telescopic flashlight is partially or fully extended, and retractable when said inside cylindrical barrel is partially or fully compressed therein; and a plurality of set screws equally spaced about the rear portion of said outside cylindrical barrel, having means to engage or disengage said inside cylindrical barrel when partially extended or compressed, in conjunction with said cylindrical barrels having matching threads engageable when fully extended to retain the maximum number of batteries.

2. A telescopic flashlight as recited in claim 1 wherein at least two cylindrical barrels coupled together form said adjustable flashlight housing capable of retaining said variable number of batteries in series alignment having means whereby the batteries can be added or subtracted when the flashlight housing is extended or compressed.

3. A telescopic flashlight as recited in claim 1 wherein a series-parallel switch is incorporated in the flashlight circuit for purposes of actuating one lamp bulb independently or more than one concurrently, to increase or decrease the intensity of the light beam, and to provide a back-up system in the event that one lamp bulb or one battery fails.

4. A telescopic flashlight as recited in claim 1 wherein said head assembly threadably attached to said outside cylindrical barrel act as a combined unit comprising a face cap engageable to the head retaining a lens, and a substantially parabolic reflector with an extended cylindrical portion that serve as a focusing shield for said lamp bulbs.

5. A telescopic flashlight comprising:

at least two adjustable cylindrical barrels of different diameters interconnected to retain a variable number of batteries in series alignment;

a head assembly engageable at a second end of an outside cylindrical barrel having means for retaining a face cap and lens engageable with the head and removably attached therefrom;

a substantially parabolic reflector attached to said lens inside said face cap is adapted with an extended cylindrical portion;

means to serve as a focusing shield for one or more lamp bulbs located inside said head assembly;

a cup-shaped lamp bulb holder threadably attached to said outside cylindrical barrel retains at least two lamp bulbs mounted against reflective conducting plates separately attached to the face of said lamp bulb holder;

means to act as partial reflectors of light, and to connect separate conducting leads to a series-parallel switch capable of actuating one lamp bulb independently or more than one concurrently based on voltage and current variations established by an increase or decrease in the number of batteries inserted or removed from the adjustable flashlight housing;

a conductive element attached to the inner wall of said inside cylindrical barrel has an extended sliding contact in electrical connection with another conductive element attached to the inner wall of said outside cylindrical barrel;

means to connect said conductive elements in series with said series-parallel switch attached to the wall of said outside cylindrical barrel, along with a metal disc and a spring element retained by a tail cap threadably attached to the inside cylindrical barrel;

a negative ease electrode of the rearmost battery is in electrical contact with said spring element;

means for the positive electrode of the forwardmost battery to receive current flowing through the series connected batteries to deliver current to a conducting pin and washer-like conductor in common electrical contact with the positive tips or electrodes of said lamp bulbs.

6. A telescopic flashlight as recited in claim 5 wherein said face cap threadably attached to said head can be rotated axially in a direction away from the head and cylindrical barrel causing said cylindrical portion of said parabolic reflector attached to said lens and face cap to move forward to serve as said focusing shield for one or more lamp bulbs retained in said cup-shaped lamp bulb holder threadably attached to said outside cylindrical barrel.

7. A telescopic flashlight as recited in claim 6 wherein a focusing divider attached to the front end of a dielectric shaft located in the center of the lamp bulb holder serves to assist the parabolic reflector with its extended cylindrical portion, in focusing and splitting the light beam emanating from said lamp bulbs.

8. A telescopic flashlight as recited in claim 5 wherein said head assembly and face cap is adapted to be completely disengaged from the outside cylindrical barrel allowing the flashlight operation to remain intact, thereby permitting a broad dispersion of spherical illumination enabling the flashlight to perform similar to an electric torch when held vertically or similar to a table lamp when placed vertically on a flat horizonal surface.

9. A telescopic flashlight as recited in claim 5 wherein said conducting pin retaining said washer-like conductor connects to said dielectric shaft centrally engageable to said cup-shaped lamp bulb holder.

10. A telescopic flashlight comprising:

an outside and inside cylindrical barrel interconnected to slide one within the other with adjusting means to retain a variable number of flashlight batteries; and a plurality of spring loaded retractable alignment bars retained by a plurality of elongated recess covers equally spaced and attached to the outer surface of said outside cylindrical barrel;

means to hold at least one additional battery in series alignment when said retractable alignment bars are in a relaxed position and retract when said inside cylindrical barrel is partially or fully compressed or collasped within said outside cylindrical barrel;

a plurality of set screws equally spaced around the rear portion of said outside cylindrical barrel having means to release or hold said inside cylindrical barrel when the adjustable flashlight housing is partially extended or fully collasped;

a head assembly threadably attached to said outside cylindrical barrel comprises a face cap, lens, and a substantially parabolic reflector with an extended cylindrical portion that act as an adjustable unit threadably attached to the head;

means whereby rotation of said face cap in an axial direction away from said head and outside cylindrical barrel causes the extended cylindrical portion of said parabolic reflector to serve as a focusing shield for one or more lamp bulbs located inside said head assembly;

a cup-shaped lamp bulb holder threadably attached to said outside cylindrical barrel retains one or more lamp bulbs mounted against reflective conducting plates in separate electrical connection controlled by a series-parallel switch;

means to actuate one lamp bulb independently or more than one concurrently to accommodate variations of current and voltage imposed by said variable number of batteries retained in said adjustable flashlight housing;

a focusing divider attached perpendicular to the front end of a dielectric shaft in the center of the lamp bulb holder serve to assist the focusing capability of said parabolic reflector with the extended cylindrical portion.

11. A telescopic flashlight comprising:

at least two cylindrical barrels interconnected to slide one within the other with the capacity to retain a variable number of batteries;

a face cap, lens, and substantially parabolic reflector with an extended cylindrical portion connects a head threadably attached to an outside cylindrical barrel;

a lamp bulb holder threadably attached to said outside cylindrical barrel serve as a receptable for more than one lamp bulb;

a series-parallel switch with means to control said lamp bulbs independently or concurrently is incorporated in the flahlight circuit;

a conducting pin in electrical contact with a positive electrode of the forwardmost battery, retains a washer-like conductor in common contact with the positive electrodes of the lamp bulbs;

a tail cap engageable with an inside cylindrical barrel retains a metal disc and spring element connecting the negative case electrode of the rearmost battery;

means whereby current flows through said batteries in series alignment to the positive electrode of the forwardmost battery to enter said conducting pin and washer-like conductor connecting said positive electrodes or tips of said lamp bulbs connecting the filiaments;

a reflective conducting plate connecting the negative electrode of said lamp bulb is separately attached to the flat front portion of said lamp bulb holder;

means to receive separate current flowing from illuminated filiaments via conducting leads connecting said series-parallel switch which connects conductive elements in electrical contact with said metal disc and spring element adjacent to the rearmost battery;

an adaptor for each individual flashlight battery wherein batteries of smaller size can be utilized to operate in a standard size flashlight housing.

12. A telescopic flashlight as recited in claim 11 wherein said adaptor comprises a dielectric tube, spring member and a cup-shaped electrical contact;

means to house individual flashlight batteries of smaller diameter and length to be adapted for use in a flashlight housing of greater diameter and length.

* * * * *